US006941614B2

(12) United States Patent
Montgomery

(10) Patent No.: US 6,941,614 B2
(45) Date of Patent: Sep. 13, 2005

(54) CARPET GROOMING ATTACHMENT

(76) Inventor: John E. Montgomery, 527 Nottingham, San Antonio, TX (US) 78209

( * ) Notice: Subject to any disclaimer, the term of this patent is extended or adjusted under 35 U.S.C. 154(b) by 280 days.

(21) Appl. No.: 10/154,461

(22) Filed: May 23, 2002

(65) Prior Publication Data

US 2003/0217430 A1 Nov. 27, 2003

(51) Int. Cl.[7] ..... A47L 9/06

(52) U.S. Cl. ..... 15/322; 15/338; 15/398; 15/414; 134/21

(58) Field of Search ..... 15/320, 321, 322, 15/398, 338, 414, 400, 340.1; 134/21

(56) References Cited

U.S. PATENT DOCUMENTS

| | | | | | |
|---|---|---|---|---|---|
| 2,941,233 | A | * | 6/1960 | Prong | 15/398 |
| 3,370,315 | A | | 2/1968 | MacFarland et al. | |
| 4,019,218 | A | * | 4/1977 | Cyphert | 15/321 |
| 4,069,541 | A | * | 1/1978 | Williams et al. | 15/321 |
| 4,075,733 | A | * | 2/1978 | Parise et al. | 15/322 |
| 4,429,432 | A | | 2/1984 | Copeland et al. | |
| 4,498,214 | A | | 2/1985 | Oxel | |
| 4,573,235 | A | | 3/1986 | Baird, Sr. et al. | |
| 4,688,294 | A | * | 8/1987 | Simonsson | 15/398 |
| 4,953,254 | A | | 9/1990 | Kohl et al. | |
| 4,956,891 | A | * | 9/1990 | Wulff | 15/320 |
| 5,432,975 | A | * | 7/1995 | Hilmanowski | 15/320 |
| 5,455,982 | A | * | 10/1995 | Armstrong et al. | 15/320 |
| 6,088,873 | A | * | 7/2000 | Pacchini et al. | 15/320 |
| 6,131,240 | A | * | 10/2000 | Shark et al. | 15/320 |
| 6,263,539 | B1 | * | 7/2001 | Baig | 15/322 |
| 6,376,542 | B1 | * | 4/2002 | Hansen et al. | 514/544 |

* cited by examiner

*Primary Examiner*—Theresa T. Snider
(74) *Attorney, Agent, or Firm*—Debra G. Shoemaker

(57) ABSTRACT

A carpet grooming attachment for a motorized brush device, the attachment having a generally triangular shaped housing; the attachment attaching to the wheel axle of a motorized brush device; a brush; means for delivering fluid attached to a external surface of the housing; and means for providing suction to the housing. The means for delivering a fluid may have at least one interchangeable and adjustable spray tip to deliver the fluid. The carpet grooming attachment of the present invention may have a pre-spray hose. The invention also includes a carpet-cleaning device with an attachment and methods of cleaning carpets using a motorized brush device with a carpet grooming attachment.

36 Claims, 3 Drawing Sheets

CARPET GROOMING ATTACHMENT

BACKGROUND OF THE INVENTION

1. Field of the Invention

The present invention relates to a carpet grooming attachment for use in connection with a pile lifter or other motorized brush. The carpet grooming attachment has particular utility in connection with grooming, cleaning, or extracting fluid from a surface such as a carpet while also providing relief from back pain for the user of a grooming machine.

2. Description of the Prior Art

Carpet cleaning attachments are desirable to provide a convenient means to clean carpets and other surfaces.

The use of carpet cleaning attachments is known in the prior art. For example, U.S. Pat. No. 3,370,315 to MacFarland et al. discloses a rug cleaner attachment. The device of the MacFarland patent '315 attaches to a conventional vacuum cleaner. The cleaner attachment of the MacFarland patent '315 has a brush portion, a suds delivery means, and a suds collection chamber. The device of the MacFarland patent '315 is attached to a vacuum cleaner by a flange on top of the housing. However, the MacFarland patent '315 does not provide for an attachment that is adjustable nor easily removable from the vacuum cleaner. To remove the attachment of the MacFarland patent '315, the entire housing comprising the brush, a suds delivery means, and a suds collection chamber must be removed. Further, the suds collection chamber is open and contained with in the attachment making removal of dirty suds inconvenient. Finally, the MacFarland patent '315 does not provide for a pre-spray option to enhance cleaning by the attachment device.

Similarly, U.S. Pat. No. 4,573,235 to Baird et al. discloses a rug cleaning attachment that has a brush portion, a suds delivery means, and a suds collection chamber. The device of the Baird patent '235 is attached to a vacuum cleaner by a flange on top of the housing. However, the Baird '235 patent does not provide for an attachment that is adjustable nor easily removable from the vacuum cleaner. To remove the attachment of the Baird patent '235, the entire housing comprising the brush, a suds delivery means, and a suds collection chamber must be removed. Further, the suds collection chamber is open and contained with in the attachment making removal of dirty suds inconvenient. Finally, the Baird patent '235 does not provide for a pre-spray option to enhance cleaning by the attachment device.

U.S. Pat. No. 4,953,254 to Kohl et al discloses a coupling means for detachably fastening to a cleaner apparatus a spray nozzle and suction unit having its own roller. The attachment disclosed by the Kohl patent '254 comprises a housing enclosing both a spray nozzle and suction means. The Kohl patent '254 device comprises one fixed spray nozzle. In order to connect the attachment of the Kohl patent '254 to a cleaner, the device must first be modified with a coupling means. The Kohl '254 patent does not describe an attachment with a quick release mechanism to remove the attachment from the cleaner chassis. Further, the Kohl patent '254 does not describe an attachment that can be used without prior modification of the cleaner to which it is to be attached. Finally, the Kohl patent '254 does not describe an apparatus with multiple adjustable spray nozzles for application of a cleaning spray nor a pre-spray option.

U.S. Pat. No. 4,498,214 to Oxel discloses an auxiliary cleaning device for a vacuum cleaner. The attachment of the Oxel '214 patent is secured to the handle assembly of a conventional vacuum cleaner. The Oxel '214 patent does not disclose an attachment that is adjustable or has a quick release mechanism. The Oxel '214 patent does not disclose multiple adjustable spray nozzles for application of a cleaning spray nor a pre-spray option. In the Oxel '214 patent, the spray nozzle is not attached to an external surface of the housing.

Lastly, U.S. Pat. No. 4,429,432 to Copeland et al discloses an apparatus for spraying a fluid mixture behind and substantially in the path of a floor cleaner. The apparatus of the Copeland '432 patent has at least one spray nozzle positioned in the housing. However, the Copeland '432 patent does not disclose an attachment that is adjustable or has a quick release mechanism In the Copeland '432 patent, the spray nozzle is not attached to an external surface of the housing, nor is the spray nozzles of the Copeland '432 patent adjustable.

While the above-described devices fulfill their respective, particular objectives and requirements, the aforementioned patents do not describe a carpet grooming attachment that attached to an existing apparatus in an adjustable and quick release manner where the attachment has multiple adjustable spray nozzles attached to an external surface of the attachment housing. The MacFarland '315, Baird '235, Oxel '214, and Copeland '432 patents make no provision for an attachment that is neither adjustable nor easily removable from the vacuum cleaner. The Kohl '254 patent makes no provision for an attachment that may be added to an existing cleaning apparatus without prior modification of the cleaning apparatus. To remove the attachment of MacFarland '315 and Baird '235 patents, the entire housing comprising the brush, a suds delivery means, and a suds collection chamber must be removed. The fluid collection chamber in the attachments of MacFarland '315 and Baird '235 patents is open and contained with in the attachment making removal of dirty suds inconvenient. Finally MacFarland '315, Baird '235, Oxel '214, Copeland '432, and Kohl '254 patents do not provide for a pre-spray option to enhance cleaning by the attachment device.

Therefore, a need exists for a new and improved carpet grooming attachment, which can be used for enhancing grooming by an existing apparatus. In this regard, the present invention substantially fulfills this need. In this respect, the carpet grooming apparatus according to the present invention substantially departs from the conventional concepts and designs of the prior art, and in doing so provides an apparatus primarily developed for the purpose of improving carpet grooming by providing an apparatus that is adjustable and attachable to an existing device in a quick release manner, the attachment having multiple adjustable spray nozzles for spraying a fluid.

SUMMARY OF THE INVENTION

In view of the foregoing disadvantages inherent in the known types of carpet grooming attachment now present in the prior art, the present invention provides an improved carpet grooming attachment, and overcomes the above-mentioned disadvantages and drawbacks of the prior art. As such, the general purpose of the present invention, which will be described subsequently in greater detail, is to provide a new and improved carpet grooming attachment, a carpet grooming apparatus, and methods of grooming carpets or other surfaces which has all the advantages of the prior art mentioned heretofore and many novel features that result in a carpet grooming attachment which is not anticipated, rendered obvious, suggested, or even implied by the prior art, either alone or in any combination thereof.

The present invention provides the added advantages of providing an attachment useful for multiple purposes. The carpet grooming attachment may be used for cleaning carpets, for removal of floodwater from a carpet or other surface, for extraction of fluid, for providing a pre-spray or pre-scrub fluid to a surface, for lifting the pile of a carpet and for grooming a carpet or other surface.

To attain this, the present invention essentially comprises a carpet grooming attachment for a motorized brush device, the attachment having a generally triangular shaped housing; means for attachment of the carpet grooming attachment to the wheel axels of a motorized brush device; a brush, means for delivering fluid to a surface to be worked; and means for providing suction to the housing.

The invention also includes numerous variations. For example, the carpet grooming attachment of the present invention may have a housing with a semi-rounded edge. The attachment of carpet grooming attachment to the motorized brush device may be adjustable and may be composed of a flange attached to the housing at one end and, at the opposite end, have a hook shape to accommodate the wheel axels of a motorized brush device. The attachment of the carpet grooming attachment is adjustable from side to side of the axel and adjustable in the length of the attachment. The attachment means may further have a swing arm to permit the carpet grooming attachment to move outside of the travel path of a motorized brush device to which the carpet grooming attachment is attached. The means for delivering fluid may have an inlet section for connection to a fluid source, a feeder tube section, and at least one or four spray tips to deliver the fluid to a surface to be worked. The spray tips may be interchangeable for different sizes and adjustable for different spray angles and spray rates. The carpet grooming attachment of the present invention may have a pre-spray hose having a quick release host adapter for attachment to a fluid source, a hose, and a removable spray tip.

The invention also includes a carpet grooming device having an attachment, the attachment including a housing, means for attaching the attachment to the device, a brush, means for delivering fluid to the attachment, and means for providing suction to the attachment.

The invention also includes methods of cleaning carpets or other surfaces using a motorized brush device with a carpet grooming attachment, the attachment having a housing; means for attaching the attachment to the device; a brush, means for delivering fluid to the attachment; and means for providing suction to the attachment. The invention also includes methods of protecting a carpet by applying a carpet protection solution using the abovementioned device. The invention also includes methods of washing a carpet with water using the abovementioned device. The invention also includes methods of removing water from a surface or carpet using the abovementioned device.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved carpet grooming attachment that has all of the advantages of the prior art carpet grooming attachment and none of the disadvantages.

It is another object of the present invention to provide a new and improved carpet grooming attachment that may be easily and efficiently manufactured and marketed.

An even further object of the present invention is to provide a new and improved carpet grooming attachment that has a low cost of manufacture with regard to both materials and labor, and which accordingly is then susceptible of low prices of sale to the consuming public, thereby making such carpet grooming attachment economically available to the buying public.

Still another object of the present invention is to provide a new carpet grooming attachment that provides in the apparatuses and methods of the prior art some of the advantages thereof, while simultaneously overcoming some of the disadvantages normally associated therewith.

Even still another object of the present invention is to provide a carpet grooming attachment that provides a source means for deep down water vacuum cleaning removing dirt and grime.

Still yet another object of the present invention is to provide a carpet grooming attachment for providing relief from back pain associated with non self-propelled carpet grooming units.

Another object of the present invention is to provide a carpet grooming attachment for providing a self-propelled water extraction system for flood restoration.

Yet another object of the present invention is to provide a carpet grooming attachment for providing fluids, including but not limited to, fabric protection to be applied to carpets without the hassle of a spray pump can.

Lastly, it is an object of the present invention to provide a new and improved carpet grooming attachment for setting the nap of the carpet to be more easily vacuumed.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
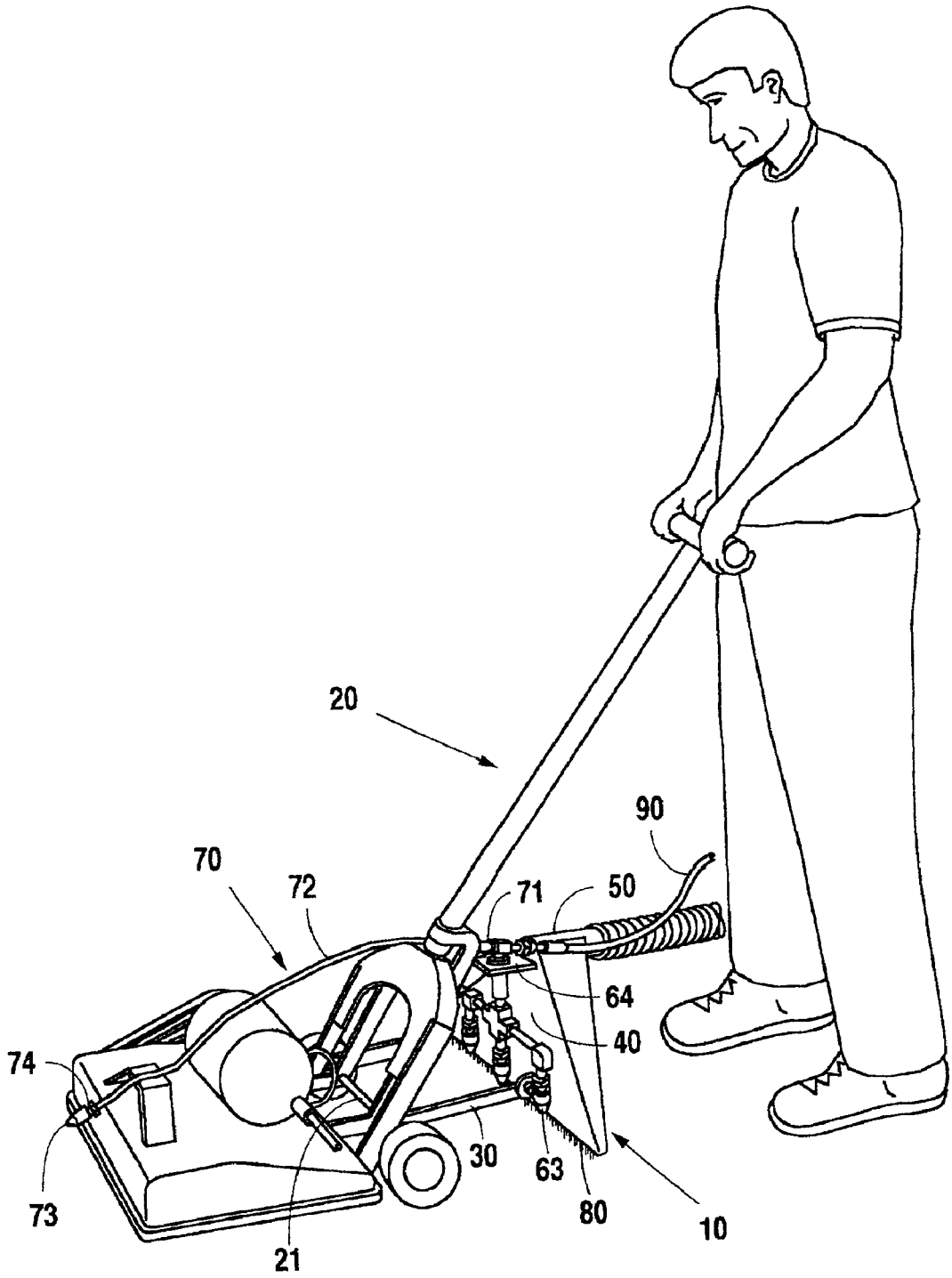
FIG. 1 is a perspective view of the preferred embodiment of the carpet grooming attachment shown with a motorized brush device constructed in accordance with the principles of the present invention.

The present invention relates to carpet grooming attachments for pile lifters or other motorized brush device with a wheeled axel located on the back of the device and with pulling power to be effective. The invention over comes many problems including: a) providing a source means for deep down water vacuum cleaning removing dirt and grime, b) providing relief from back pain associated with non self-propelled carpet grooming units, c) providing a self-propelled water extraction system for flood restoration, d) providing fluids, including but not limited to, fabric protection to be applied to carpets without the hassle of a spray pump can and e) setting the nap of the carpet to be more easily vacuumed.

Referring now to the drawings, and particularly to FIGS. 1–4, a preferred embodiment of the carpet grooming attachment of the present invention is shown and generally designated by the reference numeral 10.

FIG. 1, a new and improved carpet grooming attachment 10 of the present invention for ease of working on a surface is illustrated and will be described. More particularly, the carpet grooming attachment 10 is shown in relationship to a motorized brush device 20. The motorized brush device 20 has at least one set of wheels connected by a wheel axel 21. The wheeled axel 21 is located at the back of the motorized brush device 20. The carpet grooming attachment 10 has a housing 40. Preferably the housing 40 is a generally triangular shape. The carpet grooming attachment 10 has means for attaching 30 the carpet grooming attachment 10 to the motorized brush device 20. The means for attaching 30 the carpet grooming attachment 10 to the motorized brush device 20 is adjustable. For example, the length of the means for attaching 30 may be varied and the carpet grooming attachment is adjustable from one side of the axel 21 to the other. In one embodiment, the means for attaching 30 may swing out to function outside of the path of the motorized brush device. The carpet grooming attachment includes means for delivering a fluid to a surface to be worked upon, such as spray nozzles 63 for spraying a fluid onto a surface to be worked. The means for delivering a fluid to a surface to be worked upon is connected to the housing for example, by a bracket 64. A fluid supply hose 90 supplies fluid to the spray nozzles 63. The fluid supply hose 90 supplies fluid to spray nozzles 63 and to a pre-spray hose noted generally with the reference numeral 70. The pre-spray hose may include a fitting 71 to fit the fluid supply hose 90, a length of hose 72 sufficient to reach a desired spray surface, a spray tip or nozzle 73 and an adapter 74 between the hose 72 and spray tip or nozzle 73. The housing 40 also includes means 50 for providing suction to the housing 40. The housing 40 also includes, at a bottom edge, a brush 80. In use, the carpet grooming attachment 10 is attached to the motorized brush device 20 via a means for attaching 30 and the user walks behind the device while the motorized brush device pulls the motorized brush device 20 and the carpet grooming attachment 10 across a surface to be worked. The means for providing suction 50 is connected to a suction source (not shown in the Figure) and fluid is supplied to the pre-spray hose 70 and spray nozzle 63 through fluid supply hose 90 from a fluid source (not shown in the Figure). In one embodiment, the fluid source and the suction source are truck mounted fluid and auctions sources. In another embodiment, the fluid and suction sources are portable. In yet another embodiment, the fluid and suction source are contained within the motorized brush device.

Figure 2:
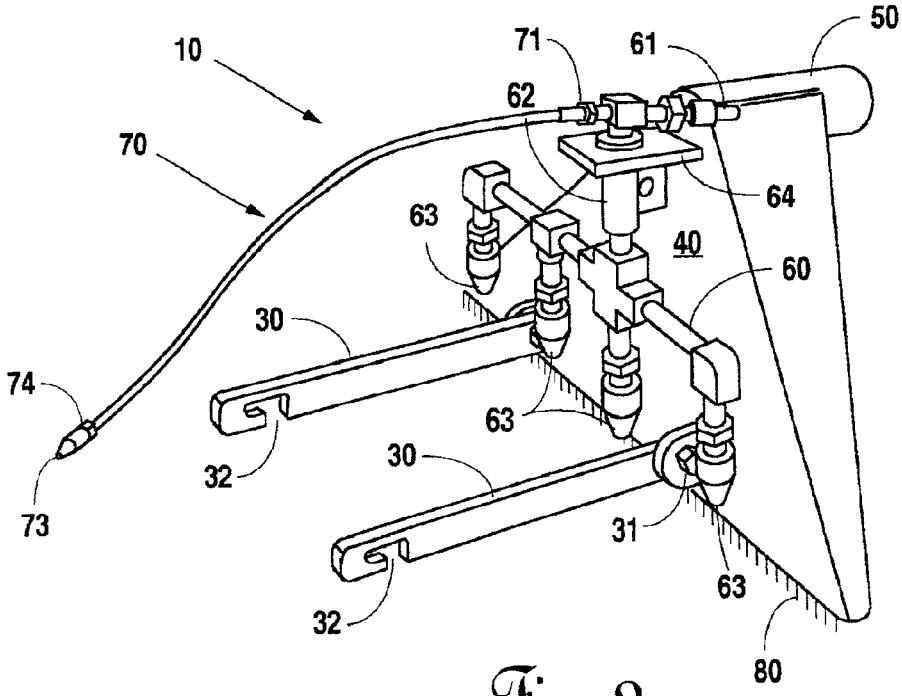
FIG. 2 is a perspective view of the carpet grooming attachment of the present invention.

In FIG. 2, the new and improved carpet grooming attachment 10 of the present invention is shown. The carpet grooming attachment 10 has a generally triangular shaped housing 40. The carpet grooming attachment 10 includes means for attaching the carpet grooming attachment to a motorized brush device, in a preferred embodiment, the carpet grooming attachment 10 has flange 30 that is secured to the housing 40 of the carpet grooming attachment 10 at one end 31 and has at the opposite end, a hook shape 32 to accommodate and secure the wheel axel of a motorized brush device (not shown in the Figure). The housing of the carpet grooming attachment has on a side means for providing suction 50 to the housing 40. The carpet grooming attachment of the present invention also includes a means for delivering fluid 60. In a preferred embodiment, the means for delivering fluid 60 may be attached to an external surface of the housing 40. The means for delivering fluid 60 may comprise an inlet section 61 for connection to a fluid source, the fluid source is not shown in FIG. 2. The means for delivering fluid 60 may further comprise a feeder tube section 62, and at least one spray tips or nozzle 63 to deliver a fluid to a surface to be worked upon. The spray tips or nozzles 63 are interchangeable with spray tips of different sizes and each spray tip is adjustable for different spray angles and spray rates. A connection 64 for attaching the means for delivering fluid 60 to the housing 40 is also provided. Also connected to a fluid source is a pre-spray hose, noted generally with the reference numeral 70. The pre-spray hose 70 may include a fitting 71 to connect to a fluid source, a length of hose 72 sufficient to reach a desired spray surface, a spray tip or nozzle 73 and an adapter 74 between the hose 72 and spray tip or nozzle 73. As shown in the Figure, in a preferred embodiment, the fitting 71 to connect to the pre-spray hose to a fluid source and the inlet section 61 of the means for delivering fluid 60 are both connected to a fluid source with a common fitting. At a bottom edge of the housing 40 is a brush 80.

Figure 3:
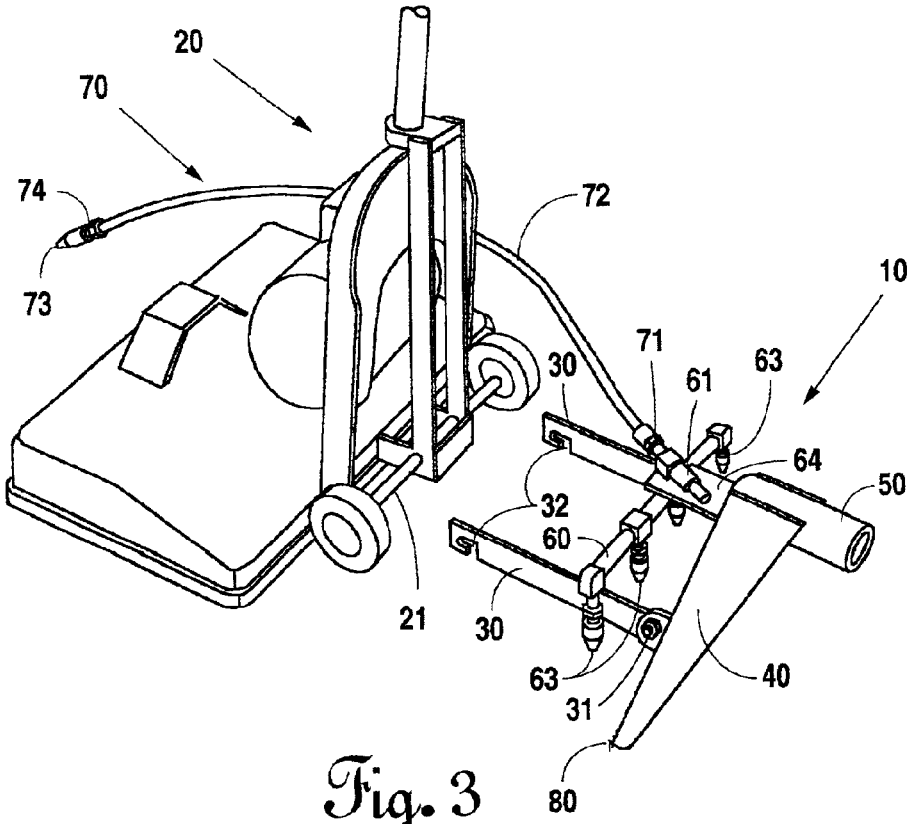
FIG. 3 is a perspective view of the carpet grooming attachment of the present invention, shown in relationship with a motorized brush device.

In FIG. 3, the new and improved carpet grooming attachment 10 of the present invention is shown. This Figure shows the carpet grooming attachment 10 of the present invention in relationship to a motorized brush device 20, prior to attaching the carpet grooming attachment to the motorized brush device. The caret grooming attachment 10 has a generally triangular shaped housing 40. The carpet grooming attachment 10 includes means for attaching the carpet grooming attachment to a motorized brush device 20. In a preferred embodiment, the carpet grooming attachment 10 has flange 30 that is secured to the housing 40 of the carpet grooming attachment 10 at one end 31 and has at the opposite end, a hook shape 32 to accommodate and secure the wheel axel 21 of a motorized brush device. The housing of the carpet grooming attachment has on a side means for providing suction 50 to the housing 40. The carpet grooming attachment of the present invention also includes a means for delivering fluid 60. In a preferred embodiment, the means for delivering fluid 60 may be attached to an external surface of the housing 40. The means for delivering fluid 60 may comprise an inlet section 61 for connection to a fluid source, the fluid source is not shown in FIG. 3. The means for delivering fluid 60 may further comprise at least one spray tips or nozzle 63 to deliver a fluid to a surface to be worked upon. The spray tips or nozzles 63 are interchangeable with spray tips of different sizes and each spray tip is adjustable for different spray angles and spray rates. In a preferred embodiment, four spray nozzles are used, although any configuration that adequately supplies fluid to a surface to be worked may be substituted for the configuration shown in the Figures. A connection 64 for attaching the means for delivering fluid 60 to the housing 40 is also provided. Also connected to a fluid source is a pre-spray hose, noted generally with the reference numeral 70. The pre-spray hose 70 may include a fitting 71 to connect to a fluid source, a length of hose 72 sufficient to reach a desired spray surface, a spray tip or nozzle 73 and an adapter 74 between the hose 72 and spray tip or nozzle 73. As shown in the Figure, in a preferred embodiment, the fitting 71 to connect to the pre-spray hose to a fluid source and the inlet section 61 of the means for delivering fluid 60 are both connected to a fluid source with a common fitting. At a bottom edge of the housing 40 is a brush 80.

Figure 4:
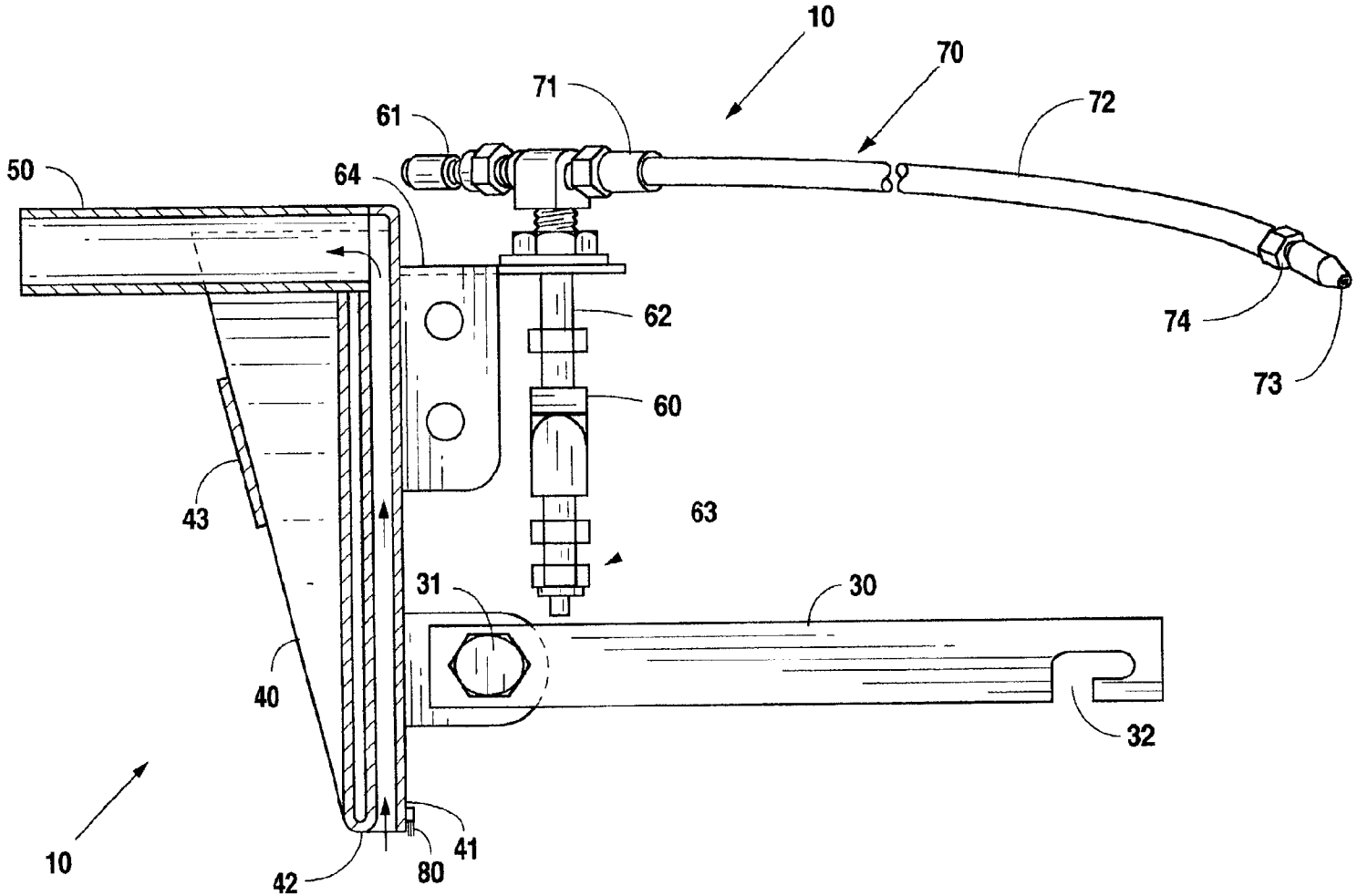
FIG. 4 is a partial cross-sectional view of the carpet grooming attachment of the present invention.

FIG. 4 is a partial cross-sectional view of the carpet grooming attachment 10 of the present invention. The carpet grooming attachment 10 has a generally triangular shaped housing 40. The carpet grooming attachment 10 includes means for attaching the carpet grooming attachment 10 to a motorized brush device (not shown in Figure). In a preferred embodiment, the carpet grooming attachment 10 has flange 30 that is attached to the housing 40 of the carpet grooming attachment 10 at one end 31 and has at the opposite end, a hook shape 32 to accommodate and secure the wheel axel of a motorized brush device (not shown in the Figure). The carpet grooming attachment of the present invention also includes a means for delivering fluid 60. In a preferred embodiment, the means for delivering fluid 60 may be attached to an external surface of the housing 40. The means for delivering fluid 60 may comprise an inlet section 61 for connection to a fluid source, the source is not shown in the Figure. The means for delivering fluid 60 may further comprise a feeder rube section 62, and at least one spray tips or nozzle 63 to deliver a fluid to a surface to be worked upon. The spray tips or nozzles 63 are interchangeable with spray tips of different sizes and each spray tip is adjustable for different spray angles and spray rates. A connection 64 for attaching the means for delivering fluid 60 to the housing 40 is also provided. Also connected to a fluid source is a pre-spray hose, noted generally with the reference numeral 70. The pre-spray hose 70 may include a fitting 71 to connect to a fluid source, a length of hose 72 sufficient to reach a desired spray surface, a spray tip or nozzle 73 and an adapter 74 between the hose 72 and spray tip or nozzle 73. As shown in the Figure, in a preferred embodiment, the fitting 71 to connect to the pre-spray hose to a fluid source and the inlet section 61 of the means for delivering fluid 60 are both connected to a fluid source with a common fitting. The housing of the carpet grooming attachment has on a side means for providing suction 50 to the housing 40. At a bottom edge of the housing 40 is a brush 80. The edge 41 of the housing 40 that first comes into contact with the fluid soaked surface is straight and flat at the bottom while the opposed edge 42 of the housing 40 is semi-rounded. As shown in FIG. 4, a bracket or brace 43 which serves as a counter-balance is placed on a surface of the housing opposite the means for attachment and/or means for delivering fluid. Arrows in FIG. 4 show the direction of travel of the fluid sprayed onto a surface by the means for delivering fluid 60. Generally, the means for providing suction generates a pressure within the housing so that the fluid sprayed on the surface to be worked travels from the surface to be worked upon, through a portion of the housing, out the means for providing suction 50 and to a collection source. The edge 41 of the housing that first comes into contact with the surface to be worked upon, or leading edge is straight and flat so as to force the sprayed fluid under the housing where the vacuum/suction then forces the fluid up a portion of the housing, through the means for providing suction 50 and to a collection source. The opposite edge 42 of the housing is formed in such a way as to enhance the collection of the fluid through the portions of the housing under vacuum/suction. In a preferred embodiment, the edge 42 of the housing 40 is semi-rounded or rounded. However, it will be appreciated that variations to this section of the housing that enhance in the removal of fluid from the surface are also encompassed. It is further appreciated that the area subject to suction within the housing may be varied depending upon the needs of the user. For example, a housing to encompass a larger surface area may be desired, or a larger portion of the housing subject suction may be desired. These various embodiments are encompassed within the present invention.

With respect to the housing of the carpet grooming attachment, it will be appreciated that although a generally triangular shaped housing is shown, the housing may be a different dimension. For example, the housing may be generally square or rectangular. The dimensions of the housing may be changed depending upon the need of the user and the surface to be worked. In some cases smaller or larger housings may be appropriate. The bracket or brace 43 that serves as a counterbalance on the housing 40 may be of any shape or dimension and may be made of any material. The housing may be made of any appropriate material or combination of materials. For example, steel, aluminum, other metal or plastic.

With respect to the brush of the carpet grooming attachment, preferably a row of brush bristles is present on an external surface of the housing. Preferably the brush is on the bottom of the housing surface and is on the surface of the housing that first comes into contact with the surface to be worked. Preferably the brush grooms the surface to be worked and preferably the brush is located barely at the surface level. Preferably the brush is located under or near the spray nozzles of the means for delivering fluid. In this manner the brush may work the fluid through the surface to be worked one more time before the fluid is removed via suction of the fluid through the housing. The brush may be permanently attached to the housing or may be secured by Velcro™ or other easily removable, fastenable means. If the brush is attached by Velcro™ or other easily removable fastenable means, the brush may be removed to be cleaned or to alternate between brushes of different sizes, densities, length, or type. As an alternative means of fastening the brush to the housing, the housing may contain projections and the brush may include a brush bar that designed to slide onto the projections to secure the brush to the housing in a easily removable method. Alternatively, the brush may be permanently affixed to a rod or bar which is secured to the housing with welding, screws, glue or other means. The brush may be positioned at any angle. For example, the brush bristles may be parallel with the front surface of the housing, or may be perpendicular to front surface of the housing or at any angle there between. As another alternative, the brush may constitute a brush roller that is secured by flanges positioned at opposed ends of the housing, the flanges securing each end of a brush roller and permitting rotation thereof Alternatively, a brush bar may be located within the housing to work the fluid through the surface and aid in the removal of the fluid from the surface. In yet another embodiment, two brushes may be present, one on a bottom external housing surface and one located within the housing. The brush may be formed with bristles of any material, such as nylon or natural fibers. The brush bristles of the carpet grooming attachment may be of any density or bristle length appropriate for working fluid through a surface such as a carpet.

With respect to the means for attaching the carpet grooming attachment to the motorized brush device, as shown in the Figures, the preferred embodiment of the present invention has flange 30 that is attached to the housing 40 of the carpet grooming attachment 10 at one end 31 and has at the opposite end, a hook shape 32. The flange 30 may be attached to the housing 40 by rivets, bolts or screws 31. Alternatively, the housing and flange may be made as a single article of manufacture. The flange may be made of any appropriate material, for example steel aluminum or other metal, plastic or wood. The flange may be of any thickness or length appropriate for the purpose. Alternatively, the flange may be secured by rivets, bolts, screws, or the like to a motorized brush device and have means, at the opposite end of the flange, for securing the carpet grooming attachment. In the preferred embodiment, the flange has a hook shape at one end. In use, an opening of the hook shape is put over and onto a wheel axel The carpet grooming attachment is then pulled so that the axel rests in an upper end of the hook shape. By these means, the carpet grooming attachment is attached securely and quickly to the motorized brush device and further, the carpet grooming attachment may be easily removed from the motorized brush device by pushing the carpet grooming attachment so that the opening of the hook shape is moved to be directly over the axel and then pulling the carpet grooming attachment up so that the axel may exit the opening of the flange. It will be appreciated however that other quick attach/release means may be used on the attachment means of the carpet grooming attachment of the present invention. For example, the end of the flange that attached to the motorized brush device may have two adjustable claw means that grab and secure the axel Alternatively a spring-loaded structure that can open and close around the axel may be used. Other means of attaching the carpet grooming attachment to the motorized brush device are also envisioned. As an additional alternative, one flange, located centrally on the housing may be used instead of two, as shown in the Figures.

In addition, as shown in the Figures, the housing has means for providing suction 50 to the housing 40. In this case the terms suction and vacuum are interchangeable and intended to mean that a form of pressure is generated so that when the housing contacts a surface, fluid on or in the surface is subjected to a pressure that causes the fluid to be removed through an opening in the housing, through the means, through a conduit connecting the means to a suction source, and into a collection source. Suction/vacuum may be generated by a positive displacement pump. It is appreciated however, that any means of generating a pressure within a housing that causes fluid or the like present on a surface to be moved into a housing is encompassed by the present invention and further any type of pressure that permits fluid removal is also encompassed. It is further appreciated that any degree of pressure needed to efficiently remove fluid or the like from a surface through the housing is encompassed by the present invention. In the preferred embodiment, the means includes a section of pipe or tubing that extends out from the housing on a side of the housing opposite the side having the means for attachment. The means for providing suction is located generally at the top of the housing, whereas the means for attachment is present generally near the bottom of the housing. The dimensions of the pipe or tubing of the means for providing suction may be varied depending upon the needs of the user and the surface to be worked. For bigger jobs, or any time more fluid will need to be supplied, a larger dimensioned pipe or tube may be preferred. The pipe or tube may be made of any appropriate material, such as steel, aluminum, other metal, plastic, or combination of materials. The means for providing suction 50 may also include a means for attaching to a vacuum/suction source. For example if a vacuum/suction source is equipped with its own pipe, tube, conduit or other outlet means, the means for providing suction 50 of the carpet grooming attachment may be equipped with any appropriate means for connecting to the pipe, tube, conduit or other outlet means of the vacuum/suction source. The means for providing suction 50 to the housing may be connected to a flexible conduit attached to a vacuum/suction source, not shown in the FIGS. 2–4. A section of flexible conduit from a vacuum/suction source is shown in FIG. 1 in part. The means for providing suction 50 may be connected by a long flexible conduit to a truck mount vacuum or suction source. Alternatively, the means for providing suction 50 may be connected to a portable source or a motorized brush device mounted source or another source. In the preferred embodiment, the means for providing suction 50 is placed on a side of the housing opposite the side having the means for attachment for the convenience of the user. This for example, might be the preferred embodiment if the means for providing suction is connected to a long flexible conduit that leads to a truck mount vacuum/suction source. It will be appreciated however, that the means for providing suction 50 may be placed on the housing anywhere that does not interfere with the other functions of the carpet grooming attachment. For example, the means for providing suction 50 could be placed directly on top of the housing and come straight up from the housing instead of to the side as shown in the Figures. Alternatively, the means for providing suction 50 could be placed closer to the bottom of the housing, on a side of the housing, or on the same side of the housing as the means for attachment. This latter embodiment may be preferred, for example if the means for providing suction is mounted on the motorized brush device.

The Figures also show, attached to the housing 40 on a side, a means for delivering fluid 60. In a preferred embodiment, the means for delivering fluid 60 may be attached to an external surface of the housing 40. The means for delivering fluid 60 may comprise an inlet section 61 for connection to a fluid supply hose 90 which leads to a fluid source, the fluid source not shown in FIGS. 2–4. A section of fluid supply hose 90 is shown in FIG. 1. The inlet section 61 is a conduit or fitting for connecting to a fluid supply hose. In the preferred embodiment shown in the Figures, the inlet section 61 is a male type connection that clicks onto a female adaptor common to most types of high-pressure hoses. The means for delivering fluid 60 may further comprise a feeder tube section 62, and at least one spray tip or nozzle 63 to deliver a fluid to a surface to be worked upon. What is meant by a feeder tube section 62 is a tube or conduit that extends from the connection to the fluid supply to the spray nozzles. The structure of this section is generally a tube or conduit that branches and then extends to meet the spray nozzles or tips. The spray tips or nozzles 63 are interchangeable with spray tips of different sizes and each spray tip is adjustable for different spray angles and spray rates. The carpet grooming attachment of the present invention may be provided with at least one spray nozzle or as many spray nozzles as needed to sufficiently provide fluid to the surface to be worked. The spray nozzles are adjustable to increase or decrease the fluid flow rate and adjustable in position to aim the fluid to a particular site. The spray nozzles are adjustable to any convenient angle of spray. The structure of the spray tip or nozzle may be made in any way that provides for adjustment of the nozzle. The spray tips or nozzles 63 are also interchangeable with different nozzles to meet the individual needs of the user. Preferably, the spray nozzles are connected to the means for delivering fluid 60 in such a manner that they may be easily removed but also water tight, for example by a brass fitting, screw, washer, nut and bolt or the like. The spray tips or nozzles 63 may include a mesh strainer within the nozzle to prevent contaminants from being sprayed on the surface. A connection 64 for attaching the means for delivering fluid 60 to the housing 40 is also provided. In a preferred embodiment, as shown in the Figures, the connection provides a flat surface for accommodating and holding in place the inlet section 61 and the feeder tube section 62. The connection 64 is also secured to the housing by any appropriate means such as welding, glue or screws. The connection may be located at any distance desired from the housing itself. For example, if longer contact of the fluid with the surface to be worked is desired, the means for delivering fluid may be placed farther from the housing. The connection 64 may be made of any material such as metal or plastic. The connection 64 may take any form that secures the means for delivering fluid to the housing. For example, the means for delivering fluid may rest directly on the housing and the connection may comprise a hook or latch. Alternatively, the connection may be located on top of the housing. The connection may also be attached to any portion of the means for delivering fluid. The means for delivering fluid 60, including the inlet section 61 for connection to a fluid source, a feeder tube section 62, and at least one spray tips or nozzle 63 may be a single article of manufacture. Thereby numerous articles or manufacture, each with a unique spray nozzle number, size and configuration may be produced. Each unique article of manufacture representing a spray unit is interchangeable with each other so that the user may easily identify and change the desired spray unit easily and quickly. As another alternative, the section below the feeder tube and including the spray tips or nozzle may be a single article of manufacture. Thereby numerous articles or manufacture that comprise the spray nozzle section of the means for delivering fluid, each with a unique spray nozzle number, size and configuration may be produced. Thus permitting the user to use several spray tip or nozzle configurations each connecting with a common section of the means for delivering fluid including the inlet section 61 for connection to a fluid source. The means for delivering fluid including the inlet section 61 for connection to a fluid source, a feeder tube section 62, and at least one spray tips or nozzle 63 may be made in any appropriate dimensions and shapes and made of any appropriate, water tight material such as metal, plastic, or a combinations of such materials. For example, the means for delivering fluid may be made of iron with brass couplings. The inlet section 61 for connection to a fluid source may comprise any convenient means for connecting to a fluid source. Preferably the connection from the means for delivering fluid to a fluid source provides a quick release mechanism to connect in a watertight manner to a high-pressure fluid hose. The fluid to be supplied may be water, a cleaning fluid, or a fabric protection fluid, a deodorizer or other fluid. In a preferred embodiment, the means for providing fluid is present on the external surface of a surface of the housing that first comes in contact with the surface to be worked. In another embodiment, the means for delivering fluid and the attached adjustable spray tips or nozzles are located within the housing. In yet another embodiment, the means for delivering fluid and the attached adjustable spray tips or nozzles are located both on an external surface of the housing and within the housing itself.

As shown in the Figures, the carpet grooming attachment of the present invention may also include a pre-spray hose 70. The pre-spray hose 70 has an adaptor 71 for attaching to a fluid supply, a length of hose 72 sufficient to reach a desired spray surface, and an adjustable and removable spray tip 73, and an adapter 74 between the hose 72 and spray tip or nozzle 73. As shown in the Figures, in a preferred embodiment, the fitting 71 to connect to the pre-spray hose to a fluid source and the inlet section 61 of the means for delivering fluid 60 are both connected to a fluid source with a common fitting. However, the fitting 71 may be separate and distinct from the inlet section 61 of the means for delivering fluid. For example, if different fluids are to be delivered to the pre-spray hose and the means for delivering fluid, then separate and distinct fittings and conduits will be used to provide different fluids. Further, since the pre-spray hose is not required to use the carpet grooming attachment of the present invention, there may be occasions when the carpet grooming attachment is used without a pre-spray hose. In this case, a different fitting or a fitting adaptable to function with or without the pre-spray hose will be needed. Alternatively, the carpet grooming attachment of the present invention may be used with a pre-spray hose and not a means for delivering fluid. In this case a different fitting or a fitting adaptable to function with or without the means for delivering fluid pre-spray hose will be needed. The pre-spray hose of the present invention is adjustable in that the length of hose 72 may be varied to meet the needs of different situations and further the spray nozzle 73 is adjustable. The spray nozzle may be adjusted for different flow rates and angles of spray and may be interchangeable with different nozzles. The adapter 74 may include any means for connecting the spray nozzle 73 to the hose 72. For example, the adapter may contain a magnet and the hose 72 and/or spray nozzle 73 may be magnetic. Alternatively the adapter may include a male fitting that fits into the hose 72, the adapter also having means for attaching to a spray nozzle such as including a threaded portion of the adapter onto which a spray nozzle may be screwed. In an alternate embodiment, the spray tip and hose may be a single unit without an adapter there between.

The carpet grooming attachment may also be outfitted with numerous attachments. For example, a shield may be added to an external surface of the housing to aid in directing the spray of the means for delivering fluid into the path of the housing. The shield preferably would be attached to the external surface of the housing by screws, or similar means. The shield preferably would stand a few inches tall and be made of a sturdy material such as plastic. The shield preferably would be generally rounded and would prevent spray of fluid outside of the path of the housing. The housing may be outfitted with wheels, rollers or casters if extra maneuverability of the carpet grooming attachment is needed. The wheels, rollers or casters should not interfere with the configuration of the carpet grooming attachment and the close contact between the surface to be worked and the housing so as to permit the carpet grooming attachment to function as designed.

In use, a motorized brush device is placed onto a surface to be worked upon and plugged into a power source. Preferably the surface worked upon is a carpet. In the following example, the surface to be worked upon is a carpet to be cleaned. However, it will be appreciated that the device of the present invention may be used to work on any appropriate surface. The motorized brush device has a brush rotated by a motor. The brush may be used to loosen dirt, grime or stains in the carpet, to work a carpet protection solution into carpet fibers or to set the pile of a carpet. The motorized brush device may be used alone or in combination with a carpet grooming attachment. When a carpet grooming attachment is to be used, a motorized brush device is placed onto a surface to be worked upon and plugged into a power source. A carpet grooming attachment is then attached to the wheel axel of the motorized brush device by positioning an opening of the hook shape of the attachment over and onto a wheel axel of a motorized brush device. The carpet grooming attachment is then pulled so that the axel rests in an upper end of the hook shape. The carpet grooming attachment is then connected to a suction source and a fluid supply source. In one embodiment, the carpet grooming attachment is attached to a truck mount suction source and truck mount fluid supply source. In another embodiment, the suction source and fluid supply source are portable. In yet another embodiment, the suction source and fluid supply source are part of the motorized brush device. If a pre-spray hose is to be used, the hose is connected to the carpet grooming attachment and positioned to spray in front of the brush of the motorized brush device. An adjustable nozzle may be added to the end of the hose of the pre-spray unit with an adapter. The nozzle of the pre-spray hose may be adjusted to permit the optimal flow of fluid onto the surface. When the motorized brush device is turned on and the carpet grooming attachment is attached to a suction and fluid source, a user standing behind the motorized brush device and carpet grooming attachment will adjust a handle of the motorized brush device to a comfortable working level and let the motorized brush device/carpet grooming attachment combination pull itself across the surface to be worked upon. The pre-spray hose will spray a fluid such as water, cleaning solution, a fiber protection solution, and a deodorizer or anti-mildew solution onto the surface. The brush of the motorized brush device works the fluid into the carpet. The means for delivering fluid of the carpet grooming attachment will then spray fluid onto the carpet through adjustable nozzles. The brush of the carpet grooming attachment provides an additional working of the fluid through the carpet fibers. When the housing itself passes over surface sprayed with the fluid, the suction source will remove the fluid from the surface through the inside of the housing, through the attached conduit and into a collection tank. The first edge of the carpet grooming attachment housing that comes in contact with the fluid sprayed surface presses down on the surface to ensure entry into the housing of the fluid sprayed surface while the back edge of the carpet grooming attachment housing is designed to enhance the removal of the fluid from the surface. For example, the back edge of the carpet grooming attachment housing may be rounded to scoop up or catch any fluid in the surface and remove it by the suction provided within the housing.

In the preferred embodiment, the carpet grooming attachment is dragged on the surface under the power of the motor of the motorized brush device to enhance the cleaning effect of the carpet grooming attachment. However, it will be appreciated that the carpet grooming attachment of the present invention may be outfitted with rollers, wheels, casters to enhance the maneuverability of the carpet grooming attachment provided that the carpet grooming attachment is sufficiently close to a surface to supply a fluid and remove the fluid by suction provided within the housing.

In a preferred embodiment, the carpet grooming attachment is adjustable. The carpet grooming attachment may be easily attached and detached from the motorized brush device. The carpet grooming attachment may be adjusted from one side of the wheel axel to the other side. The distance between the carpet grooming attachment and the motorized brush device may be adjusted. Further, the carpet grooming attachment may be adjustable in that the attachment may swing out from behind the motorized brush device. For example, to reach a comer or other hard to reach place, the user may pause the motorized brush device, and swing the carpet grooming attachment over to a hard to reach portion of the surface to be worked upon. If the carpet grooming attachment of the present invention is used to clean a long office hallway, with several door entries, the use of a carpet grooming attachment that is adjustable and can be used to clean each door entry as the motorized brush device/carpet grooming attachment combination is pulled down the hallway is very advantageous. The entire motorized brush device/carpet grooming attachment combination does not need to be moved every time the machine comes to a door entry but simply the carpet grooming attachment may be adjusted to clean this small section of surface that the motorized brush device may not easily reach. Alternatively, since the carpet grooming attachment is provided with a quick release, the carpet grooming attachment may be removed from the motorized brush device and used manually to clean a hard to reach surface.

In a preferred embodiment, the carpet grooming attachment of the present invention is used with a cleaning solution source to provide an attachment, a device for grooming carpets and methods of grooming, cleaning, washing or extracting fluid from a carpet or other surface. However, it can be appreciated that the carpet grooming attachment of the present invention and the combination device of a motorized brush device and a carpet grooming attachment has numerous uses. For example, the carpet grooming attachment can be used to remove water from a flooded surface. In this case, the means for delivering fluid may not be used at all, or the carpet grooming attachment may be used with a cleaning solution or fluid protection solution. The carpet grooming attachment of the present invention and the combination device of a motorized brush device and a carpet grooming attachment can be used to wash a surface with water instead of a cleaning solution. The carpet grooming attachment of the present invention and the combination device of a motorized brush device and a carpet grooming attachment can be used to add a desired treatment to a surface. For example a fluid protection solution, such as Scotchguard™ may be applied to a surface with the carpet grooming attachment of the present invention or the combination device of a motorized brush device and a carpet grooming attachment and a Scotchguard™ supply source. The present invention has the added advantage of not requiring the user to manually spray the surface with the treatment prior to use of the carpet grooming attachment or combination device of a motorized brush device and carpet grooming attachment. Any desired fluid solution may be used with the devices of the present invention. For example, other carpet protection solutions, a deodorizer, an anti-mildew solution or other appropriate solution may be used in conjunction with the carpet grooming attachment or the combination device of a motorized brush device and a carpet grooming attachment of the present invention.

It can further be understood that the carpet grooming attachment of the present invention is versatile. For example, the carpet grooming attachment may be used without a pre-spray hose. The carpet grooming attachment may be used without supplying fluid to the means for delivering fluid, either with or without the pre-spray hose. In this way, for example, fluid may be removed from a surface using the suction provided to the housing without adding more fluid to the surface.

It can now be understood that the present invention has numerous advantages over prior art cleaning attachments including providing an easily removable carpet grooming attachment for use in deep down water vacuum cleaning to remove dirt and grime or wash a carpet, and providing a self-propelled water extraction system for flood restoration and providing efficient means for application of solutions, such as fabric protection solutions, a deodorizer, or anti-mildew solution to a surface. The present invention provides a self-propelled cleaning unit that provides relief from back pain associated with non self-propelled carpet grooming units, thereby preventing job related injuries to the user. The present invention eliminates the use of spray pump cans or other bulky and inconvenient means of applying a fluid to a surface thereby permitting the user to work more efficiently. The present invention provides a device for setting the nap of the carpet so that is can be more easily vacuumed. The present invention provides a device that can be used on any appropriate surface such as a carpet or other flooring.

While a preferred embodiment of the carpet grooming attachment has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, the shape of the housing may be generally triangular, but may also be other shapes. The spray nozzle con ion may comprise four adjustable nozzles, although any nozzle number, shape and configuration that provides adequate fluid spray may be substituted. The positioning of the means for providing fluid and the means for providing suction with respect to the housing may be varied depending upon the needs of the user. The means for attaching the carpet grooming attachment to a motorized brush device may be varied as needed but preferably an adjustable and quick release mechanism is used. Further, any suitable materials may be used to construct the carpet grooming attachment of the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A carpet grooming attachment for use in working on a surface that may be easily attached to and detached from a motorized brush device comprising:

a generally triangular shaped housing;

means for attachment of the housing to a wheel axel of the motorized brush device, wherein the means for attachment are secured to the housing;

a brush at a bottom edge of the housing;

means for delivering fluid to the surface to be worked upon attached to the housing; and means for providing suction to the housing.

2. The carpet grooming attachment of claim 1, wherein an edge of the housing is semi-rounded.

3. The carpet grooming attachment of claim 1, wherein the means for attachment of the carpet grooming attachment to the motorized brush device is adjustable.

4. The carpet grooming attachment of claim 1, wherein the means for attachment of the carpet grooming attachment to the motorized brush device includes two ends, a flange secured to the housing at one end and, at an opposite end, having a hook shape to accommodate the wheel axel of the motorized brush device.

5. The carpet grooming attachment of claim 1, wherein the brush is a brush bar located within the housing.

6. The carpet grooming attachment of claim 1, wherein the brush is located at a bottom edge of an external surface of the housing.

7. The carpet grooming attachment of claim 1, wherein the means for delivering fluid to the surface is located on an external surface of the housing and comprises a connector to attach the means to the housing, an inlet section for connection to a fluid source, a feeder tube section extending from the inlet section toward the surface to be worked upon, and at least one spray nozzle connected to the feeder tube section to deliver fluid, the spray nozzle being interchangeable for different sizes and adjustable for different spray angles and spray rates.

8. The carpet grooming attachment of claim 7, wherein the means for delivering a fluid comprises four spray nozzles.

9. The carpet grooming attachment of claim 1, further comprising a pre-spray hose connected to the means for delivering fluid having:

a hose;

a quick release host adapter at one end of the hose for attachment to the means for delivering fluid; and an adjustable spray tip at an opposite end of the hose to deliver fluid from the pre-spray hose to the surface.

10. The carpet grooming attachment of claim 9, wherein the spray tip is removable and the pre-spray hose further comprises an adapter between the hose and spray tip.

11. The carpet grooming attachment of claim 10, wherein the adapter contains a magnet.

12. A method of cleaning a carpet comprising:

applying a carpet cleaning solution to a carpet to be cleaned;

attaching the carpet grooming attachment of claim 1 to the motorized brush device, a suction source, and a cleaning solution source;

pulling the carpet grooming attachment and motorized brush device across the carpet thereby cleaning and grooming the carpet.

13. A method of washing a carpet comprising:

applying water to a carpet to be washed;

attaching the carpet grooming attachment of claim 1 to the motorized brush device, a suction source, and a water source;

pulling the carpet grooming attachment and motorized brush device across the carpet thereby washing and grooming the carpet.

14. A method of protecting carpets comprising:

applying a carpet protection solution to a carpet to be protected;

attaching the carpet grooming attachment of claim 1 to the motorized brush device, a suction source, and a carpet protection solution source;

pulling the carpet grooming attachment and motorized brush device across the carpet thereby protecting and grooming the carpet.

15. A method of removing water from a carpet comprising:

attaching the carpet grooming attachment of claim 1 to the motorized brush device and a suction source; and pulling the carpet grooming attachment and motorized brush device across the carpet thereby removing water and grooming the carpet.

16. A carpet grooming attachment for use in working on a surface for a motorized brush device comprising:

a generally triangular shaped housing;

an adjustable flange attached to the housing at one end and having at an opposite end, a hook shape to secure the housing to a wheel axel of the motorized brush device;

a brush at a bottom edge of the housing;

means for delivering fluid to the surface attached to an external surface of the housing, the means having a connector to attach the means to the housing, an inlet section for connection to a fluid source, a feeder tube section extending from the inlet section toward the surface to be worked upon, at least one adjustable spray nozzle connected to the feeder tube section to deliver fluid to the surface; and means for providing suction to the housing.

17. The carpet grooming attachment of claim 16, further comprising a pre-spray hose connected to the means for delivering fluid having:

a hose;

a quick release host adapter at one end of the hose for attachment to the means for delivering fluid; and an adjustable spray tip at an opposite end of the hose to deliver fluid from the pre-spray hose to the surface.

18. The carpet grooming attachment of claim 17, wherein the spray tip is removable and the pre-spray hose further comprises an adapter between the hose and spray tip.

19. The carpet grooming attachment of claim 18, wherein the adapter contains a magnet.

20. The carpet grooming attachment of claim 16, wherein the means for delivering fluid comprises four spray nozzles.

21. The carpet grooming attachment of claim 16, wherein the brush is a brush bar located within the housing.

22. The carpet grooming attachment of claim 16, wherein the brush is located at a bottom edge of an external surface the housing.

23. A method of cleaning a carpet comprising:

applying a carpet cleaning solution to a carpet to be cleaned;

attaching the carpet grooming attachment of claim 16 to the motorized brush device, a suction source, and a cleaning solution source source;

pulling the carpet grooming attachment and motorized brush device across the carpet thereby cleaning and grooming the carpet.

24. A method of washing a carpet comprising:

applying water to a carpet to be washed;

attaching the carpet grooming attachment of claim 16 to the motorized brush device, a suction source, and a water source;

pulling the carpet grooming attachment and motorized brush device across the carper thereby washing and grooming the carpet.

25. A method of protecting carpets comprising:

applying a carpet protection solution to a carpet to be protected;

attaching the carpet grooming attachment of claim 16 to the motorized brush device, a suction source, and a carpet protection solution source;

pulling the carpet grooming attachment and motorized brush device across the carpet thereby protecting and grooming the carpet.

26. A method of removing water from a carpet comprising:

attaching the carpet grooming attachment of claim 16 to the motorized brush device and a suction source; and pulling the carpet grooming attachment and motorized brush device across the carpet thereby removing water and grooming the carpet.

27. A carpet grooming device for use in working on a surface comprising:

a motorized brush device;

an attachment with a generally triangular shaped housing, means for attachment of the housing to a wheel axel of the motorized brush device, a brush at a bottom edge of the housing, means for delivering fluid to the surface, and means for providing suction to the housing;

a fluid supply source to supply fluid to the means for delivering fluid; and a vacuum source to supply vacuum to the means for providing suction.

28. The carpet grooming device of claim 27, further comprising a pre-spray hose connected to the means for delivering fluid having:

a hose;

a quick release host adapter at one end of the hose for attachment to the means for delivering fluid; and an adjustable spray tip at an opposite end of the hose to deliver fluid from the pre-spray hose to the surface.

29. The carpet grooming device of claim 28, wherein the spray tip is removable and the pre-spray hose further comprises an adapter between the hose and spray tip.

30. The carpet grooming device of claim 29, wherein the adapter contains a magnet.

31. The carpet grooming device of claim 27, wherein the brush of the attachment is a brush bar located within the housing.

32. The carpet grooming device of claim 27, wherein the brush of the attachment is located at a bottom edge of an external surface the of housing.

33. A method of cleaning a carpet comprising:

applying a carpet cleaning solution to a carpet to be cleaned;

attaching the carpet grooming device of claim 27 to a suction source and a cleaning solution source source;

pulling the carpet grooming device across the carpet thereby cleaning and grooming the carpet.

34. A method of washing a carpet comprising:

applying water to a carpet to be washed;

attaching the carpet grooming device of claim 27 to a suction source and a water source;

pulling the carpet grooming device across the carpet thereby washing and grooming the carpet.

35. A method of protecting carpets comprising:

applying a carpet protection solution to a carpet to be protected;

attaching the carpet grooming device of claim 27 to a suction source and a carpet protection source;

pulling the carpet grooming device across the carpet thereby and grooming the carpet with the carpet.

36. A method of removing water from a carpet comprising:

attaching the carpet grooming device of claim 27 to a suction source; and pulling the carpet grooming device across the carpet thereby removing water and grooming the carpet.

* * * * *